US007194992B2

(12) United States Patent
Smith

(10) Patent No.: US 7,194,992 B2
(45) Date of Patent: Mar. 27, 2007

(54) HYDRAULIC CUSHIONING OF A VARIABLE VALVE TIMING MECHANISM

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 82 days.

(21) Appl. No.: 11/017,449

(22) Filed: Dec. 20, 2004

(65) Prior Publication Data

US 2005/0098133 A1 May 12, 2005

Related U.S. Application Data

(63) Continuation-in-part of application No. 10/376,876, filed on Feb. 28, 2003, now Pat. No. 6,866,013.

(60) Provisional application No. 60/374,241, filed on Apr. 19, 2002.

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS

| | | | | |
|---|---|---|---|---|
| 4,601,231 | A | 7/1986 | Shimoda | 91/26 |
| 4,858,572 | A | 8/1989 | Shirai et al. | 123/90.12 |
| 5,002,023 | A | 3/1991 | Butterfield et al. | 123/90.15 |
| 5,107,804 | A | 4/1992 | Becker et al. | 123/90.17 |
| 5,172,659 | A | 12/1992 | Butterfield et al. | 123/90.17 |
| 5,184,578 | A | 2/1993 | Quinn, Jr. et al. | 123/90.17 |
| 5,289,805 | A | 3/1994 | Quinn, Jr. et al. | 123/90.17 |
| 5,361,735 | A | 11/1994 | Butterfield et al. | 123/90.17 |
| 5,497,738 | A | 3/1996 | Siemon et al. | 123/90.17 |
| 5,657,725 | A | 8/1997 | Butterfield et al. | 123/90.17 |
| 5,836,277 | A | 11/1998 | Kira et al. | 123/90.17 |
| 5,979,380 | A | 11/1999 | Nakadouzono et al. | 123/90.17 |
| 6,085,708 | A | 7/2000 | Trzmiel et al. | 123/90.17 |
| 6,247,434 | B1 | 6/2001 | Simpson et al. | 123/90.17 |
| 6,250,265 | B1 | 6/2001 | Simpson | 123/90.17 |
| 6,263,846 | B1 | 7/2001 | Simpson et al. | 123/90.17 |
| 6,311,655 | B1 | 11/2001 | Simpson et al. | 123/90.17 |
| 6,374,787 | B2 | 4/2002 | Simpson et al. | 123/90.17 |
| 6,390,043 | B1 | 5/2002 | Niethammer et al. | 123/90.17 |
| 6,553,951 | B2 * | 4/2003 | Ogawa | 123/90.17 |
| 6,866,013 | B2 * | 3/2005 | Smith | 123/90.17 |
| 2001/0022164 | A1 | 9/2001 | Ogawa | 123/90.16 |

* cited by examiner

*Primary Examiner*—Ching Chang
(74) *Attorney, Agent, or Firm*—Brown & Michaels, PC; Greg Dziegielewski

(57) ABSTRACT

A phaser comprising a housing, a rotor, and first and second passages. The housing has at least one chamber defined by an advance wall, an arcuate outer wall, and a retard wall. The rotor has at least one vane projecting from an outer circumference, separating the chamber in the housing into advance and retard chambers. The first passage facilitates fluid communication to a first port in the advance or retard chamber and a second passage to a second port in the other advance or retard chambers. Each port is spaced apart form the first wall or second wall of the vane, such that when the vane is moved towards the advance or retard wall of the chamber far enough, the passages are obstructed by the housing and fluid flow to the passages is restricted, such that impact of the vane with the walls of the chamber is cushioned.

4 Claims, 6 Drawing Sheets

No restriction
Restriction

HYDRAULIC CUSHIONING OF A VARIABLE VALVE TIMING MECHANISM

REFERENCE TO RELATED APPLICATIONS

This application is a continuation-in-part of parent application Ser. No. 10/376,876, filed Feb. 28, 2003 now U.S. Pat. No. 6,866,013 entitled "Hydraulic Cushioning Of A Variable Valve Timing Mechanism" which claims priority from an invention which was disclosed in Provisional Application No. 60/374,241, filed Apr. 19, 2002, entitled "Hydraulic Cushioning of a Variable Valve Timing Mechanism." The aforementioned applications are hereby incorporated herein by reference.

BACKGROUND OF THE INVENTION

1. Field of the Invention

The invention pertains to the field of variable valve timing (VCT) systems. More particularly, the invention pertains to a VCT mechanism having hydraulic cushioning.

2. Description of the Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 4,601,231 shows a rotary actuator that restricts oil flow to prevent leakage without using the sealing members of the vane and reduces the velocity of the vane as it approaches impact with the housing, thus cushioning the impact of the vane against the stops. Multiple passages and switches are used to move oil to separate passages as the vane nears the stop. The vane is used to block the primary passage and switch to the bypass circuit. Specifically, the vane blocks a main path and oil is supplied to a subpath. A small amount of oil flows into the bypath and the majority of the oil flows and pushes against a ball valve, which is in opposition to a spring. The force of the oil overcomes the spring and pushes the ball valve from its seat and oil behind the ball valve and moves into a passage which leads the oil to bear against a cutout of the vane. When the pressure is great enough, the vane separates from the stopper so that a new oil chamber is formed therebetween. At the same time, oil passes through a path and reaches a boundary between the other vane and stopper and effects a similar separation when the vane advances, opening a main oil path. The oil from the main path is fed directly into a second diametrically opposed newly opened oil chamber from the main path. Simultaneously, oil the other chamber is discharged from the oil port via the main path as the rotation of the vanes takes place. A cushion effect is created so that the impact or shock of the vane against the spring is moderate.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 5,979,380 discloses a valve timing control device with a locking mechanism for connecting the housing member and the rotor and a canceling device that cancels the locking mechanism. A vane divides a chamber into a first pressure chamber and a second pressure chamber. At least one of the walls defining the chambers has a bump or bulge into the chamber and a tapered cut bottom near the rotor. When the vane is flat or flush against the bulge, a small chamber is created with the sides being defined by the vane and the housing, the top of the chamber being the bulge and the bottom of the chamber being the rotor. The fluid flows from this chamber to passages leading to the advance or retard chambers. The ports of the passages are large and the tapered cut of the housing ensures that no obstruction of fluid can occur as the vane moves and becomes flush with the bulge of the housing.

For damping, the rotor has a receiving hole that becomes aligned with the canceling hole in the housing that receives the lock pin. The lock pin has a small diameter and a large diameter portion and is biased from the housing towards the rotor by a spring. When the rotor is rotated relative to the housing at the maximum retard condition the canceling hole and the receiving hole align and prevents the vane from colliding with the housing.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is described. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

It has became more common for variable camshaft timing mechanisms to be made in a vane/housing format. Working hydraulic chambers are created by imposing either single or multiple vanes of a rotor attached to the camshaft into a cavity in a housing that is attached to the camshaft sprocket. The circumferential length of the pocket or cavity in the housing determines the relative phase travel of the camshaft relative to the sprocket/housing. The control is accomplished by exhausting fluid such as oil from one chamber while simultaneously filling the opposing chamber. This causes the variable camshaft timing mechanism to move the camshaft relative to the crankshaft manifested in a phase position.

The rate of change of the camshaft is determined in part by how fast the oil can exhaust from the resisting or draining hydraulic chamber. As the rotor of the VCT reaches the end of its travel limited by the cavity of the housing, the rotor will impact the housing and cause undesirable noise. As can be seen, there is need in a phaser to reduce the noise at the end of travel and keeping suitable rate of change in the phase position of the camshaft.

SUMMARY OF THE INVENTION

A phaser comprising a housing, a rotor, and first and second passages. The housing has at least one chamber defined by an advance wall, an arcuate outer wall, and a retard wall. The rotor has at least one vane projecting from an outer circumference, separating the chamber in the housing into advance and retard chambers. The first passage facilitates fluid communication to a first port in the advance or retard chamber and a second passage to a second port in the other advance or retard chambers. Each port is spaced apart form the first wall or second wall of the vane, such that when the vane is moved towards the advance or retard wall of the chamber far enough, the passages are obstructed by the housing and fluid flow to the passages is restricted, such that impact of the vane with the walls of the chamber is cushioned.

DETAILED DESCRIPTION OF THE INVENTION

Figure 1:
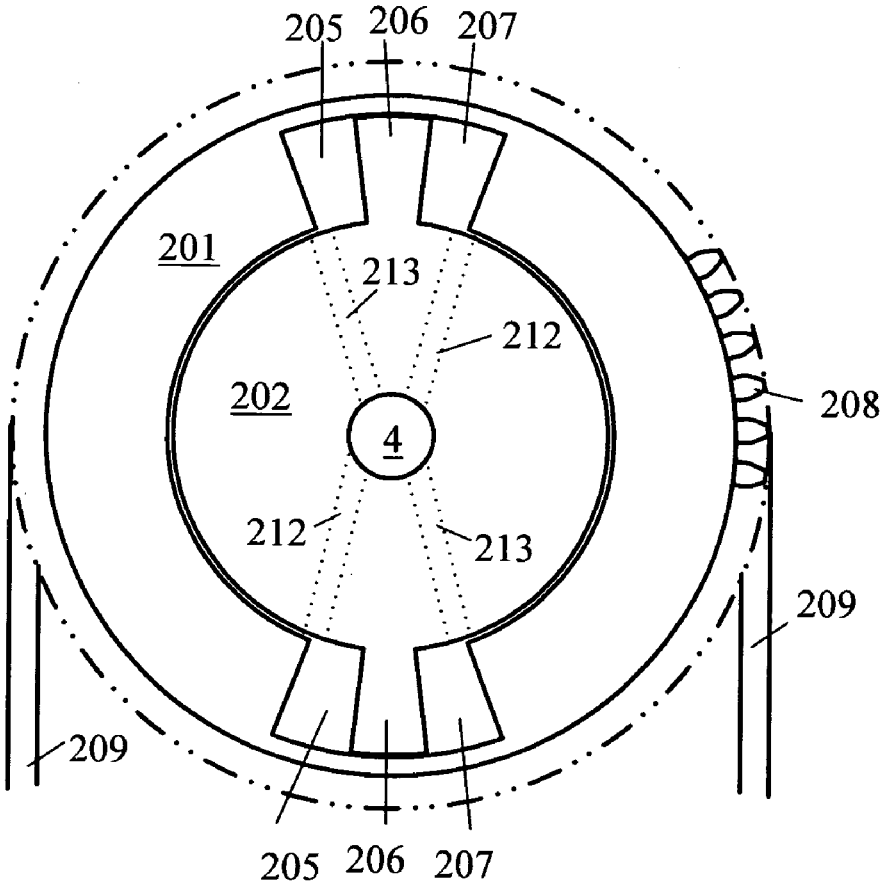
FIG. 1 shows a vane-type VCT phaser.
Figure 2A:
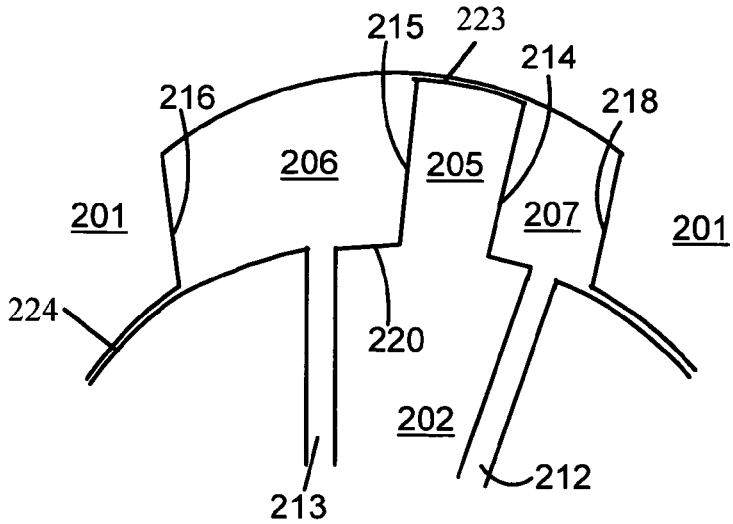
FIG. 2A shows the vane in a central or null position.
Figure 2B:
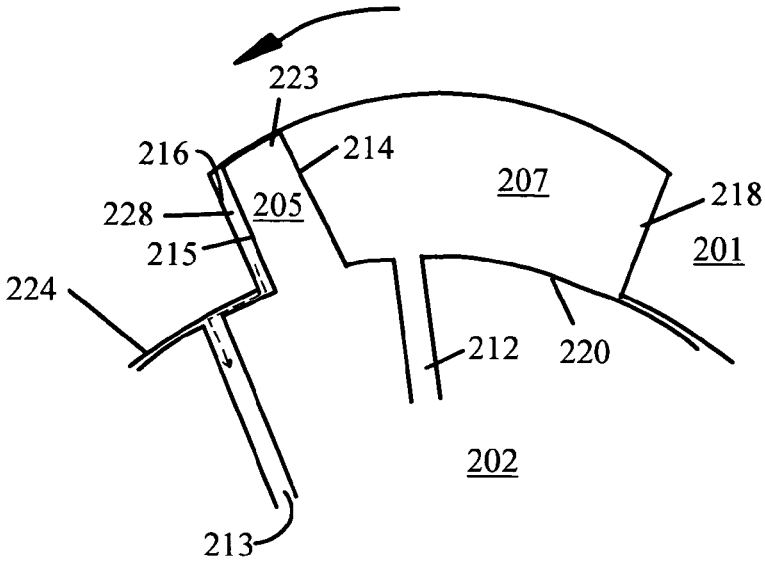
FIG. 2B shows the vane in a retard position.

Referring to FIGS. 1 through 2B, a vane-type VCT phaser comprises a housing 201, the outside of which has sprocket teeth 208 that mesh with and are driven by timing chain 209. Coaxially located within the housing 201, free to rotate relative to the housing 201, is a rotor 202 with vanes 205 projecting from the rotor's circumference 220. The vanes 205 separate chambers in the housing defined by an arcuate outer wall, an advance wall 216 and a retard wall 218 into advance and retard chambers 206, 207. The vanes 205 are formed of a first wall 215, a second wall 214, and top 223. Along the circumference of the rotor 202, a distance from the first and second walls 215, 214 of vanes 205, are advance and retard passages 213, 212 extending from chambers 206 and 207 to a central control valve 204. The central control valve 204 routes pressurized fluid to the advance and retard chambers 206, 207 by the advance and retard passages 213, 212. A small fluid passage 224 is also present between the housing 201 and the circumference 220 of the rotor 202 not exposed to the chambers 206, 207.

FIG. 2A shows a close-up of the vane 205 and the advance and retard chambers 206, 207 in a central or null position. In this position, restrictions on the fluid in the chambers 206, 207 is not present.

FIG. 2B shows the phaser in the retard position. In this position, fluid from the central control valve 204 is supplied to the retard chamber 207 from retard passage 212. The fluid entering the retard chamber 207 forces the vane 205 to move to the left as shown by the figure, to a retard position, where the first wall 215 of the vane 205 and the advance wall 216 of the housing 201 forms a fluid pocket 228. Fluid moves from the fluid pocket 228 to newly formed passage 230, where the fluid is restricted or obstructed between the housing 201 and the circumference 220 of the rotor 201 as shown by the diagonal portion of FIG. 6. From the restricted passage 230, fluid exits back to central control valve 204 through advance passage 213. Fluid in the fluid pocket 228, shown by the crosshatched portion is not under any restriction. Since fluid is restricted upon exit from the advance chamber 206 in the restricted passage 230, the movement of the vane 205 is also slowed as it nears the advance wall 216 of the chamber, cushioning the vane from impact with the advance wall 216.

As discussed in the background, undesirable noise occurs when the vane 205 slams into the advance wall 216 or the retard wall 218 of the chamber in the housing 201. The restricted passage 230 prevents the vane 205 from slamming against the advance wall 216 of the chamber of the housing 201 and similarly the retard wall 218 on the opposite side of the chamber of the housing 201 by decelerating the amount of fluid that can exit the advance chamber 206 through the restricted passage 230 as described above.

Figure 6:
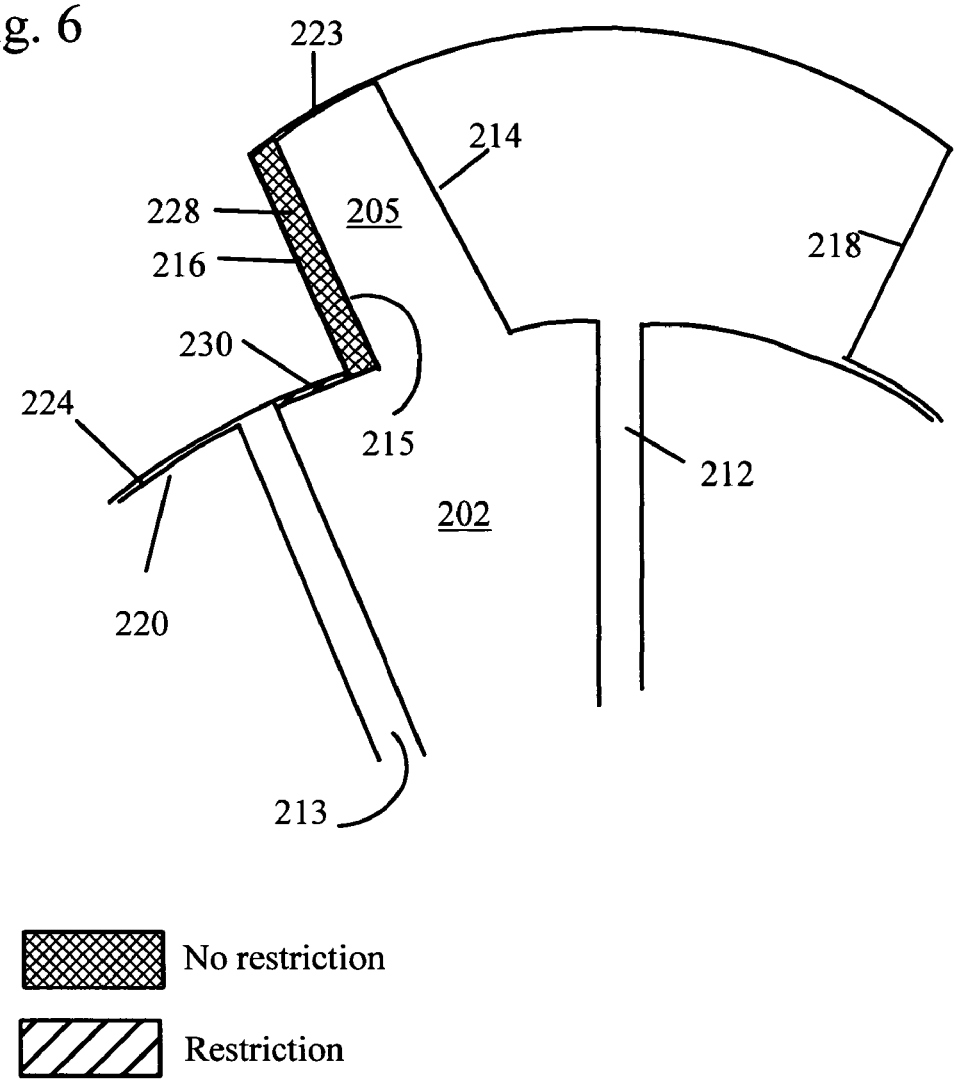
FIG. 6 shows a close-up of FIG. 2B.

While it is not shown, the same restriction occurs when the phaser is in the advance position, such that fluid is supplied from the central control valve 204 to the advance chamber 206 forcing the vane 205 to the right, to an advance position, where the second wall 214 of the vane 215 and the retard wall 218 of the housing 201 forms a fluid pocket 228. Fluid moves from the fluid pocket 228 to newly formed passage 230, where the fluid is restricted between the housing 201 and the circumference 220 of the rotor 202 not exposed to the chamber, similar to that shown by the diagonal portion of FIG. 6. From the restricted passage 230, fluid exits back to central control valve 204 through retard passage 212. Fluid in the fluid pocket 228, similar to that shown by the crosshatched portion in FIG. 6 is not under any restriction. Since fluid is restricted upon exit from the retard chamber 207 in the restricted passage 230, the movement of the vane 205 is also slowed as it nears the retard wall 218 of the chamber.

It is noted that the present invention contemplates application in any type VCT phaser including Cam Torque Actuated (CTA), oil pressure actuated (OPA), or torsion assist (TA) phasers. It is further noted that normal phasing operation is defined as the rate of change of the camshaft when passages are fully within the cavity of the housing 1.

It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed, some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Figure 3:
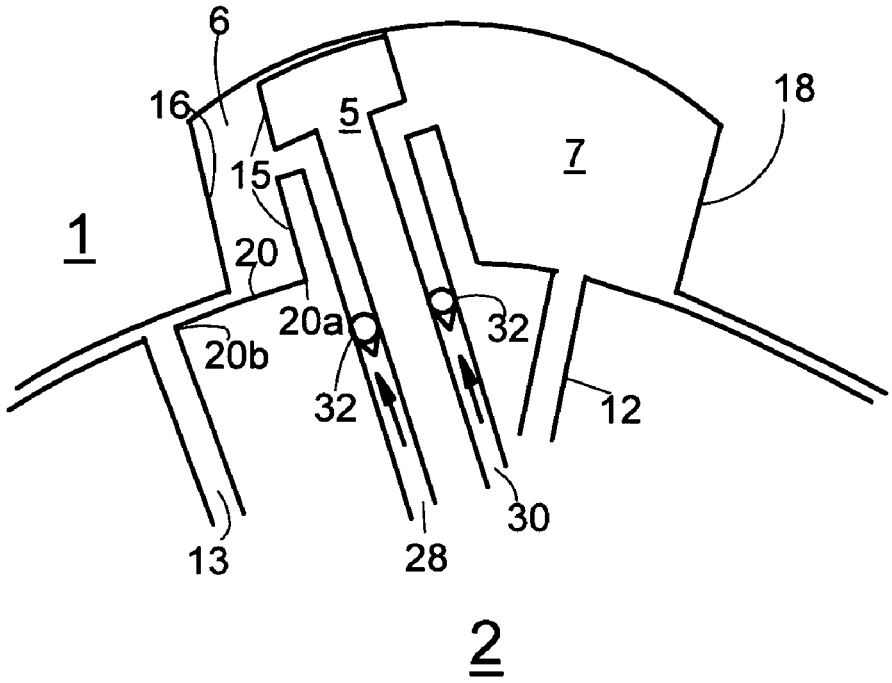
FIG. 3 shows an alternative embodiment of the present invention.

Referring to FIG. 3, an alternative embodiment of the present invention is shown. A pair of separate inlet sources 28, 30 is introduced each with a check valve 32 and a separate exhaust port 12, 13 respectively. As can be seen, the phaser of VCT system would have an unlimited supply of fluid to fill the chambers 6, 7 and their respective exhaust ports 12, 13 thereby limiting the velocity of the rotor 2 near the end of travel. Thus good VCT response in all directions is achieved while limiting the velocity and thus the impact energy as the vane 5 approaches its mechanical stops due to the physical limitations of the housing cavity.

As discussed supra, the rate of change of the camshaft is determined, in part, by how fast fluid can exhaust from the resisting hydraulic chamber. As the rotor 2 of the VCT reaches the end of its travel, as limited by the housing 1, the rotor 2 will impact the housing 1 and cause undesirable noise. The present invention permits the fluid to exhaust normally from the hydraulic chamber and thus does not limit the actuation rate of the VCT during normal phasing until the rotor nears the end of its travel. At this point the exhaust port would be restricted by the close clearance between the rotor 2 and the housing 1 by the provision of the distances 20, 22 at each end of the housing cavity respectively. In order to facilitate the normal fluid flow, separate inlet passages 28, 30 cures the possible defect of insufficient flow out of the exhaust chamber to the inlet chamber (see FIG. 3). Without the separate inlet passage, fluid might not be exhaust sufficiently during the end of travel time segments. The end result may be insufficient fluid flow out of the exhaust chamber into the opposite chamber. However, the vane still moves in that the volume of the opposite chamber is increasing. This increase may cause the opposite chamber to draw undesirable material such as ambient air around the phaser.

The present invention gradually decelerates the VCT rotor 2 to a stop, thus limiting the impact energy with which the rotor 2 impacts the housing 1. The present invention contemplates application in any type VCT phaser.

For example, in FIG. 3 when fluid is exhausting from chamber 6 via passage 13, at the end of travel of vane 5 the fluid flow rate may be decreased due to the structure of the present invention. At this juncture, chamber 7 still needs to be filled with sufficient fluid flow of a suitable rate. If the flow is below a threshold value, undesirable effects including entry of ambient air may get into chamber 7. The introduction of inflow passage 30 reduces or solves the undesirable effect problem by introducing sufficient fluid flow rate thereby resulting in sufficient fluid flow into chamber 7. Similar results occur at the opposite end of travel of the vane.

It is noted that only a portion of the phaser is shown here. The phaser may have more than one similar structure as shown in FIGS. 2A, 2B, 3, or 6. For example, the phaser may have 2, 4, or 8 similar structures.

Figure 4:
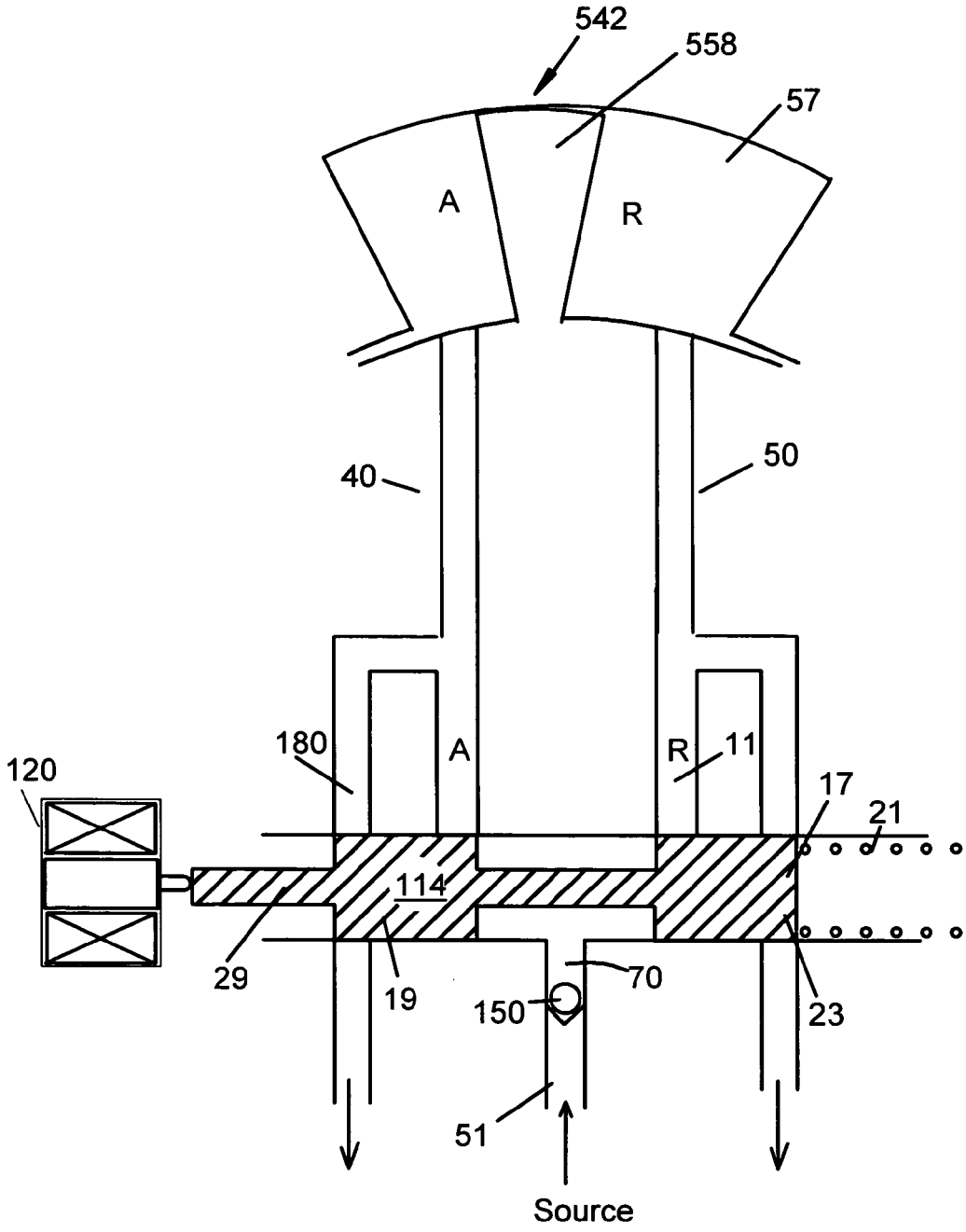
FIG. 4 shows VCT system suitable for the present invention.

FIG. 4 is a schematic depiction that shows, in part, the VCT system of the present invention. A null position is shown in FIG. 4. Solenoid 120 engages spool valve 114 by exerting a first force upon the same on a first end 29. The first force is met by a force of equal strength exerted by spring 21 upon a second end 17 of spool valve 114 thereby maintaining the null position. The spool valve 114 includes a first block 19 and a second block 23 each of which blocks fluid flow respectively.

The phaser 542 includes a vane 558, a housing 57 using the vane 558 to delimit an advance chamber A and a retard chamber R therein. Typically, the housing 57 and the vane 558 are coupled to crankshaft (not shown) and camshaft (also not shown) respectively. Vane 558 is permitted to move relative to the phaser housing by adjusting the fluid quantity of advance and retard chambers A and R. If it is desirous to move vane 558 toward the retard side, solenoid 120 pushes spool valve 114 further right from the original null position such that fluid in chamber A drains out along duct 40 through duct 180. The fluid is in fluid communication with an outside sink (not shown) by means of having block 19 sliding further right to allow said fluid communication to occur. Simultaneously, fluid from a source passes through duct 51 and is in one-way fluid communication with duct 70 by means of one-way valve 150, thereby supplying fluid to chamber R via duct 50. This can occur because block 23 moved further right causing the above one-way fluid communication to occur. When the desired vane position is reached, the spool valve is commanded to move back left to its null position, thereby maintaining a new phase relationship of the crank and cam shaft.

Figure 5:
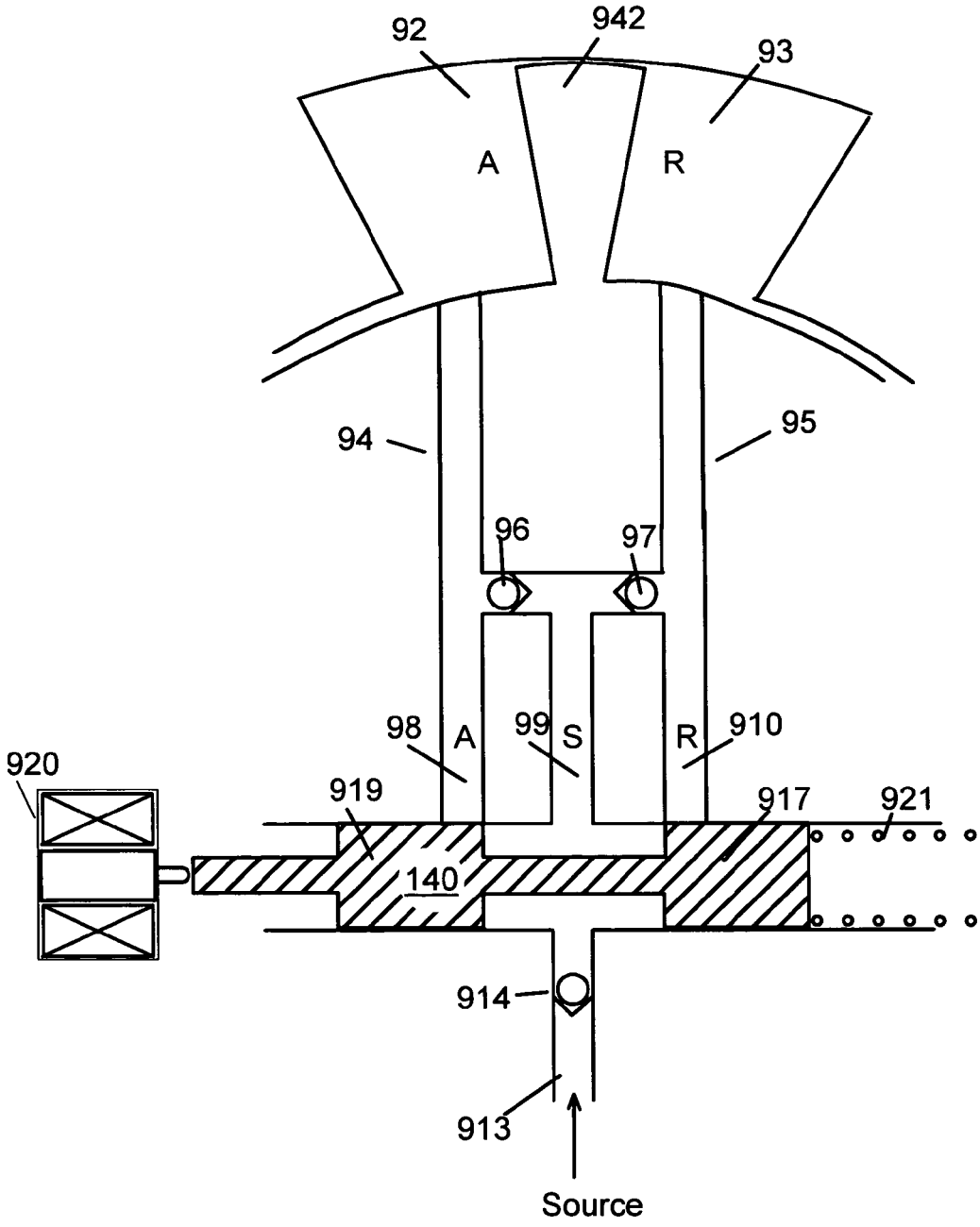
FIG. 5 shows a Cam Torque Actuated (CTA) VCT system applicable to the present invention.

Referring to FIG. 5, a Cam Torque Actuated (CTA) VCT system applicable to the present invention is shown. The CTA system uses torque reversals in camshaft caused by the forces of opening and closing engine valves to move vane 942. The control valve in a CTA system allows fluid flow from advance chamber 92 to retard chamber 93 or vice versa, allowing vane 942 to move, or stops fluid flow, locking vane 942 in position. CTA phaser may also have oil input 913 to make up for losses due to leakage, but does not use engine oil pressure to move phaser.

The detailed operation of CTA phaser system is as follows. FIG. 5 depicts a null position in that ideally no fluid flow occurs because the spool valve 140 stops fluid circulation at both advance end 98 and retard end 910. When cam angular relationship is required to be changed, vane 942 necessarily needs to move. Solenoid 920, which engages spool valve 140, is commanded to move spool 140 away from the null position thereby causing fluid within the CTA circulation to flow. It is pointed out that the CTA circulation ideally uses only local fluid without any fluid coming from source 913. However, during normal operation, some fluid leakage occurs and the fluid deficit needs to be replenished by the source 913 via a one way valve 914. The fluid in this case may be engine oil. The source 913 may be the oil pan.

There are two scenarios for the CTA phaser system. First, there is the Advance scenario, wherein an Advance chamber 92 needs to be filled with more fluid than in the null position. In other words, the size or volume of chamber 92 is increased. The advance scenario is accomplished by way of the following.

Solenoid 920 pushes the spool valve 140 toward right such that the left portion 919 of the spool valve 140 still stops fluid flow at the advance end 98. But simultaneously the right portion 917 moved further right leaving retard portion 910 in fluid communication with duct 99. Because of the inherent torque reversals in camshaft, drained fluid from the retard chamber 93 feeds the same into advance chamber 92 via one-way valve 96 and duct 94.

Similarly, for the second scenario, a retard chamber 93 needs to be filled with more fluid than in the null position. In other words, the size or volume of chamber 93 is increased. The retard scenario is accomplished by way of the following.

Solenoid 920 reduces its engaging force with the spool valve 140 such that an elastic member 921 forces spool 140 to move left. The right portion 920 of the spool valve 140 stops fluid flow at the retard end 910. But simultaneously the left portion 919 moves further right leaving Advance portion 98 in fluid communication with duct 99. Because of the inherent torque reversals in camshaft, drained fluid from the Advance chamber 92 feeds the same into Retard chamber 93 via one-way valve 97 and duct 95.

As can be appreciated, with the CTA cam phaser, the inherent cam torque energy is used as the motive force to re-circulate oil between the chambers 92, 93 in the phaser. This varying cam torque arises from alternately compressing, then releasing, each valve spring, as the camshaft rotates.

It should be noted that FIGS. 4 and 5 are used to show different types of VCT system suitable for the present invention. Some structures are not depicted in detail. For these details, refer to FIGS. 2–3.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. A vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

A chamber or cavity is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to, see if the change was made correctly and adjusts the action to achieve the desired result (e.g. moves a valve to change phaser position in response to a command from the ECU, then checks the actual phaser position and moves valve again to correct position). The control valve is a valve, which controls flow of fluid to phaser. The control valve may exist within the phaser in CTA system. The control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

A Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). The Valve Control Unit (VCU) is a control circuitry for controlling the VCT system. Typically the VCU acts in response to commands from ECU.

A driven shaft is any shaft, which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

The housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid." The lock pin is disposed to lock a phaser in position. Usually lock pin is used when oil pressure is too low to hold phaser, as during engine start or shutdown.

An Oil Pressure Actuated (OPA) VCT system uses a conventional phaser, where engine oil pressure is applied to one side of the vane or the other to move the vane.

An open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. The rotor is the inner part of the phaser, which is attached to a camshaft.

Pulse-width Modulation (PWM) provides a varying force or pressure by changing the timing of on/off pulses of voltage or fluid pressure. The solenoid is an electrical actuator, which uses electrical current flowing in coil to move a mechanical arm. A Variable force solenoid (VFS) is a solenoid whose actuating force can be varied, usually by PWM of supply voltage or with a current controller. A VFS is an alternative to an on/off (all or nothing) solenoid.

The sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

A Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

A VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine with at least one camshaft comprising:

a housing with an outer circumference for accepting drive force and at least one chamber defined by an advance wall, an arcuate outer wall, and a retard wall;

a rotor for connection to a camshaft coaxially located within the housing and having an outer circumference, and at least one vane projecting from the outer circumference of the rotor, separating the chamber in the housing into an advance chamber and a retard chamber, the vane having a first wall, a second wall, and a top and being capable of movement within the chamber to shift the relative angular position of the housing and the rotor;

a first passage facilitating fluid communication to a first port in the advance or retard chamber and a second passage facilitating fluid communication to a second port in the other advance or retard chamber, each port being spaced apart from the first wall or second wall of the vane a length along the outer circumference of the rotor sufficient such that before the vane contacts the advance wall or the retard wall, the first passage or the second passage is completely closed except for fluid from a restriction passage formed between the housing and the length of the outer circumference of the rotor;

wherein when the vane is moved within the chamber towards the advanced wall or the retard wall of the housing, the length of the outer circumference of the rotor between the first passage or the second passage and the first wall or the second wall of the vane respectively, is positioned such that the restriction passage is formed between the housing and the length of the outer circumference of the rotor, restricting fluid flow into the first passage or the second passage, cushioning impact of the vane with the advance wall or the retard wall.

2. The variable cam timing phaser of claim 1, wherein the phaser is cam torque actuated.

3. The variable cam timing phaser of claim 1, wherein the phaser is torsion assist.

4. The variable cam timing phaser of claim 1, wherein the phaser is oil pressure actuated.

* * * * *